United States Patent [19]

Livingston

[11] 4,145,106

[45] Mar. 20, 1979

[54] SHIELDING DEVICE FOR ORIENTED SPARK PLUGS

[75] Inventor: Russell G. Livingston, Redding, Calif.

[73] Assignee: Livingston Industries, Incorporated, Redding, Calif.

[21] Appl. No.: 847,124

[22] Filed: Oct. 31, 1977

[51] Int. Cl.[2] ..... H01R 13/34

[52] U.S. Cl. ..... 339/143 S; 123/169 PH; 339/26

[58] Field of Search ..... 339/26, 89 C, 143 S; 123/169 PA, 169 PH, 169 R; 313/134, 135, 144

[56] References Cited

U.S. PATENT DOCUMENTS

| | | | |
|---|---|---|---|
| 2,280,855 | 4/1942 | Rose | 339/26 X |
| 2,336,570 | 12/1943 | Rabezzana | 123/169 PH |
| 2,762,021 | 9/1956 | Battey et al. | 339/26 |
| 2,878,299 | 3/1959 | Starr | 123/169 R |
| 3,025,425 | 3/1962 | Logan | 313/135 X |

*Primary Examiner*—Roy Lake
*Assistant Examiner*—E. F. Desmond
*Attorney, Agent, or Firm*—Robert J. Schaap; Robert M. Ashen

[57] ABSTRACT

A shielding device for spark plugs which are oriented in an engine block by a key and keyway means such that the electrodes of the spark plug are located in a predetermined orientation in a combustion chamber in the engine. The spark plug is secured in place by a shielding enclosure to prevent radio frequency interference and also to provide an explosion-proof chamber around the spark plug. The shield of the spark plug is provided with an externally threaded section which is threadedly secured to a mating threaded section on the vehicle engine block. The shield is provided with an inner conical surface abutting against a shoulder on the body of the spark plug in order to axially force the plug into the engine block with shoulder to shoulder contact. The shield body is also provided with a plurality of wrenching flats enabling the shield body to be threadedly secured into the block and to press the plug into tight-fitting engagement with the engine block and thereby permit the spark plug electrodes to be located in the desired predetermined orientation in the engine block.

18 Claims, 2 Drawing Figures

SHIELDING DEVICE FOR ORIENTED SPARK PLUGS

BACKGROUND OF THE INVENTION

1. Purpose of the Invention

This invention relates in general to certain new and useful improvements in shielding devices for spark plugs used in hydrocarbon combustion engines, and, more particularly, to shielding systems for use with spark plugs connected to an engine with predetermined electrode orientation on the spark plug.

2. Brief Description of the Prior Art

Hydrocarbon combustion engines which employ spark ignition systems result in the production of radio frequency signals emanating from the ignition system. In addition, the arcing of spark plugs in an ignition system and the potential for arcing in other portions of an electrical system forming part of an internal combustion engine presents a potentially explosive environment. Thus, for vehicles and other apparatus using these forms of internal combustion engines in areas where explosive gas may be present, as for example an oil or gas well production site, or in boats where explosive gas may accumulate and where a spark may initiate an explosion, various shielding devices have been proposed for use about the spark plugs of the ignition system. Shielding jackets have also been used around ignition wiring harnesses. These forms of devices have also been required for use in military-type vehicles and other apparatus where radio equipment must be operated and in other vehicles and apparatus where radio frequency interference is undesirable.

While a spark plug may be encased in a permanent shield to obviate these problems, the permanent shielding is quite expensive and therefore economically undesirable. This is particularly true since the spark plug is often replaced with the result that the shielding is also replaced.

The prior art is exemplified by my prior U.S. Pat. No. 3,697,796, granted Oct. 10, 1972, for SPARK PLUG SHIELDING. As shown in my prior patent, the spark plug is enclosed in a shield or enclosure which is connected to the plug and provides a wrench section for enabling the plug to be screwed into the block of an engine, the shield also providing a connector means for a shielded spark plug wire.

With the advent of more sophisticated engines and turbines, it has become the practice to positively orient the spark plugs in the block or head so that the electrodes of the spark plug are positively oriented in the combustion chamber. This new practice precludes the use of the typical threaded spark plug because the orientation of the electrodes of such plugs depends upon the extent to which the plug is torqued upon installation.

Orientation of the new type spark plugs is accomplished by the provision of complemented key and keyway means in and on the block and spark plug. In such an assembly, separate means must be employed to clamp the spark plug in place in the socket in the engine. The typical clamping devices, however, interfere with the use of effective radio frequency shielding.

OBJECTS OF THE INVENTION

It is, therefore, the primary object of the invention to provide a spark plug shield which permits effective clamping action of the spark plug to an engine block and provides an enclosure for the spark plug of a type requiring electrode orientation in the engine or turbine combustion chamber.

It is another object of the present invention to provide a spark plug shield of the type stated having a section therein to engage the body of a spark plug in order to apply an axial force to the spark plug and thereby press the plug into a socket of the engine.

It is an additional object of the present invention to provide a spark plug shield of the type stated which has means cooperatable with the spark plug for retaining the spark plug in the engine combustion chamber in proper orientation and which also permits threaded attachment to the engine block.

It is yet another object of the present invention to provide a spark plug shield of the type stated which is durable in its construction and relatively economical to manufacture.

With the above and other objects in view, my invention resides in the novel features of form, construction, arrangement and combination of parts presently described and pointed out in the claims.

SUMMARY OF THE INVENTION

A spark plug shield having a body which is adapted to fit around the body of a spark plug and retain the same in a bore in an engine block, such as a hydrocarbon combustion engine block. The shield is used with spark plugs of the type which are not necessarily threadedly secured into the bore of the engine block but employ a key and keyway means in order to properly orient the electrodes on the spark plug in the engine combustion chamber.

The bore in the engine is provided with a counterbore adapted to receive an enlarged section on the spark plug in shoulder to shoulder contact. The shield of the present invention also is provided with an enlarged section for securement to the block of the engine and is similarly provided with a shoulder engaging a cooperating shoulder on the spark plug. In this way, the shield, when secured to the engine block, can apply an axial force to the spark plug in order to press the plug into the socket and retain the same therein the proper orientation.

The shield body is also provided with a hexagonal or other nut-shaped section having wrench flats enabling the shield body to be threadedly secured into and to be removed from the threaded bore in the engine and to also press the spark plug tightly against the bottom of the bore in its oriented position. In another embodiment of the present invention, U-clamps with retaining studs could be employed to retain the shield around the spark plug and to force the spark plug into tight contact with the bore in the engine block.

The enclosure is designed to prevent emanation of radio frequency signals when the plug is energized and when arcing occurs in the electrodes of the spark plugs. In addition, the shield may be provided with an insulating sleeve on the interior thereof which renders the enclosure surrounding the plug explosion proof inasmuch as no explosive gases can then enter the enclosure surrounding the spark plug.

The spark plug shield of the present invention is unique in that it actually extends into the bore of the engine block and is secured to the engine block in such manner. In this way, the entire spark plug is completely shielded, thereby providing a more complete shielding than any other form of prior art removable spark plug shield. In addition, the shield of the present invention provides a positive locking action for retaining the spark plug into the engine block. The shield has a shoulder in the area of the means for securing the shield to the block and which shoulder engages the mating shoulder on the spark plug for applying an axial force to retain the plug within the block.

This invention possesses many other advantages, and has other purposes which may be made more clearly apparent from a consideration of forms in which it may be embodied. These forms are shown in the drawings accompanying and forming part of the present specification. They will now be described in detail, for the purpose of illustrating the general principles of the invention; but it is to be understood that such detailed descriptions are not to be taken in a limiting sense.

BRIEF DESCRIPTION OF THE DRAWINGS

Figure 1:
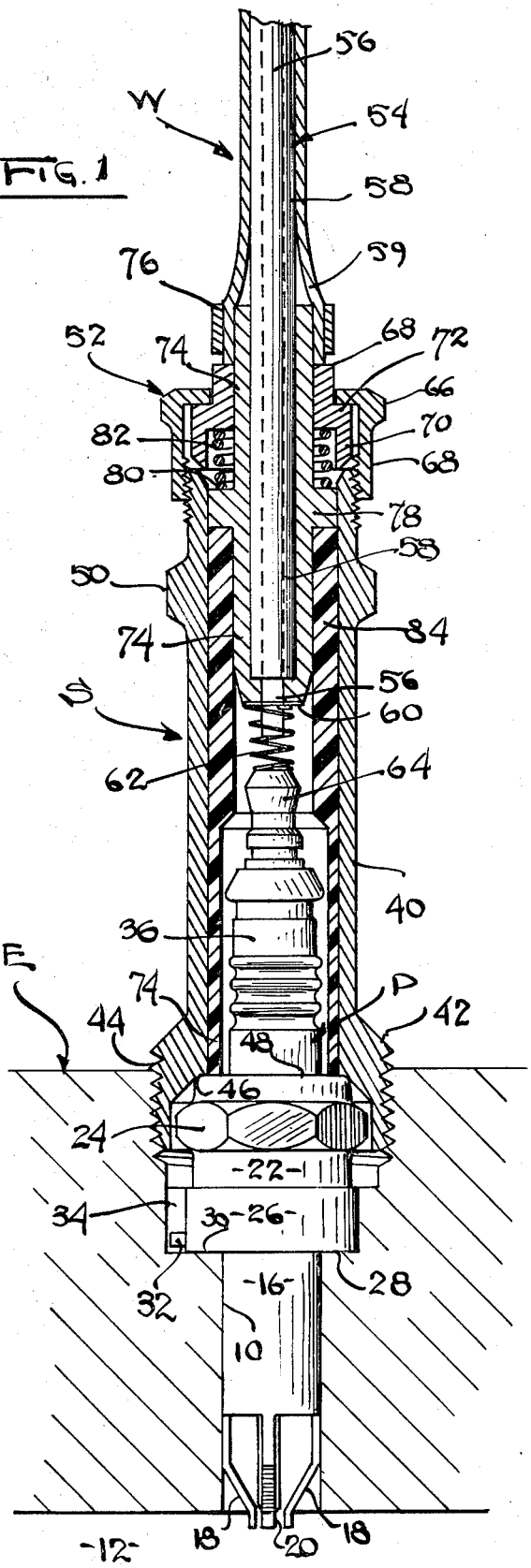
Figure 2:
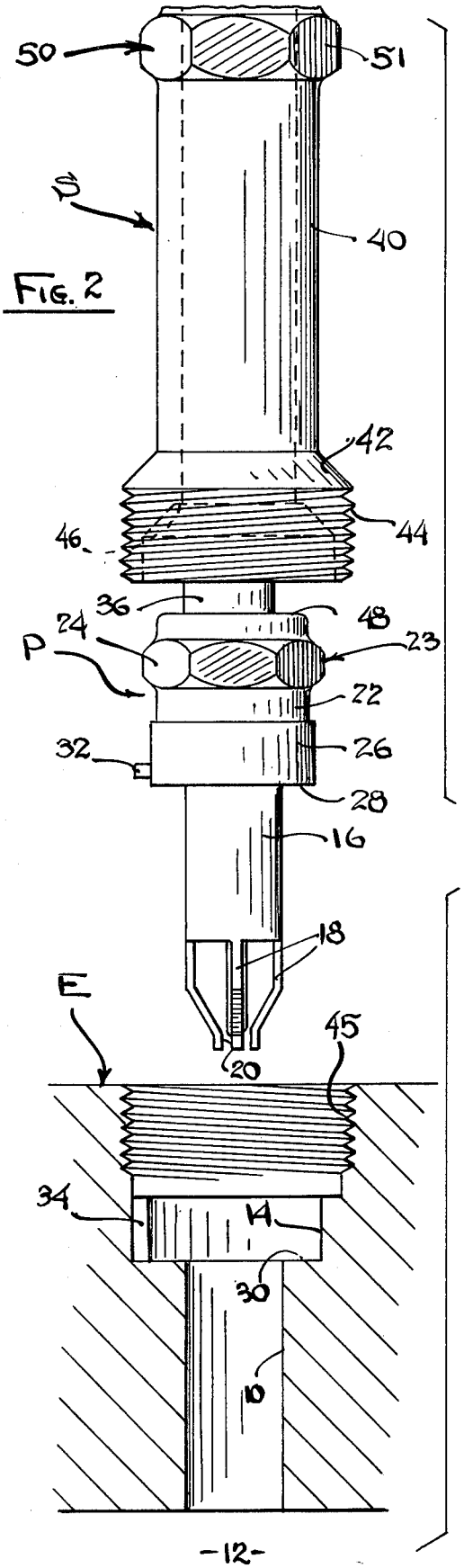

Having thus described the invention in general terms, reference will now be made to the accompanying drawings in which:

FIG. 1 is a view, partly in longitudinal section and partly in elevation, and showing the spark plug shield of the invention applied to an engine block and conventional spark plug; and FIG. 2 is a fragmentary exploded view, partially in longitudinal section and partially in elevation, and showing the spark plug shield, an engine block and spark plug.

DETAILED DESCRIPTION OF THE PREFERRED EMBODIMENTS

Referring now in more detail and by reference characters to the drawings which illustrate practical embodiments of the present invention, P designates a spark plug of the orientatable type to be used in conjunction with an engine, such as a hydrocarbon combustion engine, E, and in which the spark plug shield S of the present invention is employed.

In this respect, it should be understood that the term "engine" as used herein denotes a hydrocarbon combustion engine such as the conventional internal combustion engine and is used in the generic sense to encompass turbines and other forms of engines which employ an electrical ignition system requiring the use of spark plugs.

The engine E is provided with a spark plug bore 10 leading into a combustion chamber 12 and a counterbore 14 surrounding the spark plug bore 10 and is adapted to receive the spark plug P.

The spark plug P is of a conventional type and includes a base 16 having a plurality of electrodes 18 located within the combustion chamber 12 and forming a gap 20 so that an arc at the gap 20 will ignite a fuel charge in the combustion chamber 12. An enlarged plug section 22 on the plug P is adapted to be fitted within the counterbore, or so-called "complementary bore", 14, in the manner as illustrated in FIG. 1. The enlarged plug section 22 integrally includes a nut section 23 which is provided with wrenching flats 24, often referred to as "wrench flats". Moreover, the plug section 22 is provided with a lower boss 26 having a shoulder 28 which engages a shoulder 30 surrounding the counterbore in the manner as illustrated in FIG. 1. In addition, the plug P is provided with a key 32 which fits within a keyway 34 formed within the engine block and in this manner orients the electrodes 18 in proper relationship. The key and keyway means described actually constitute a pin 32 with a slot 34, although it should be understood that any conventional form of key and keyway means may be employed.

The plug P is also provided with an insulator 36 which surrounds the usual body conductor 38 and which is characteristically cylindrical in nature.

The shield S includes an elongate hollow body 40 adapted to be disposed about the insulator 36 of the plug P. The lower end of the body 40 integrally merges into an enlarged outwardly flaring retaining and securement flange or head 42. The flange 42 extends into the counterbore 14 in the manner as illustrated and is provided with an externally threaded section 44 for threaded mating securement to a cooperating threaded portion 45 formed in the side wall of the counterbore. In addition, the flange 42 defines an inner radially extending tapered shoulder 46 at the portion where it merges into the side wall of the housing 40 and which shoulder 46 engages a similar radially extending shoulder 48 on the plug section 22. In this way, when the shield is rotated for threadedly securing the threads 44 into the engine block, the shoulder 46 will engage the shoulder 48 on the spark plug and retentively hold the same in its oriented position within the block.

At an appropriate position, the shield body 40 has a hexagonal or other shaped section 50 having wrenching flats 51 thereon enabling the shield body to be threaded into and removed from the counterbore 14 and to thereby press the plug P tightly against the engine block such that the shoulder 28 on the plug portion will engage the shoulder 30 formed by the counterbore. Thus, it is apparent that the head 42 on the lower end of the shield and the engine block have means cooperably engageable to secure and retain the plug in place and disengageable to allow removal of the plug.

At its outer end, the shield body 40 is provided with a connector means 52 of any appropriate type adapted to secure a shielded ignition wire 54 to the spark plug shield S. The ignition wire 54 is provided with a conductor 56 shielded in an insulating cable 58 having an outer sheath 59. The lower end of the conductor 56 is provided with a contact and end 60 located within the housing 40 and which engages a contact spring 62 on a plug post 64, the latter extending from the conductor within the spark plug P.

The exact form of the connector means 52 is not critical with respect to the present invention, although the embodiment illustrated in FIGS. 1 and 2 shows the preferred embodiment. The connector means 52 adopts the form of a nut 66 threaded onto the upper end of the body 40 and which nut 66 is similarly provided with wrenching flats 68. The upper interior surface of the nut 66 acts on a sleeve 70 having an upwardly presented shoulder 72.

An interior hollow tube 74 is disposed within the housing 40 and extends upwardly beyond the upper end of the sleeve 68. A conventional clamp or band 76, such as a conventional hose clamp or the like, is used to clamp the lower end of the sheath 59 surrounding the ignition wire 54 to the upper end of the interior tube, in the manner as illustrated in FIG. 1. The interior tube 74 is also provided with an annularly extending flange 78 having an upper shouldered surface 80. The sleeve 70 is provided with a central bore which accommodates a compression spring 82 and which also bears against the enlarged flange 78 in a biasing arrangement.

Internally, the enclosure 22 has an insulating sheath 84, such as a molded fluoro-carbon which surrounds the plug and prevents arcing between the plug and the metal enclosure. If desired, the insulation may also be employed to form a seal by being engaged against the lower surface of the flange 78 and being pressed against the shoulder 46 of the plug. In this way, the sheath 84 is spring biased by the spring 82 and hollow tube 74. Such a seal renders the enclosure explosion-proof, since no explosive gases can enter the body.

In an alternate embodiment of the invention, the shield could be secured to the engine block by means of a pair of clamps in place of the threaded attachment. Thus, conventional clamps, such as the type used to secure distributor caps to the distributor body, could be employed.

The shield of the present invention also serves as a heat shield. In many high performance engines, heat insulating elements are often wrapped around the spark plug body to prevent damage and excessive deterioration of the spark plug insulative material. However, it has been found that the insulating shield of the present invention not only prevents undesirable emanation of radio frequency signals but also serves as a heat insulator.

Thus, there has been illustrated and described a unique spark plug shield which provides a means for retaining and securing a spark plug in proper alignment in an engine block and which therefore fulfills all of the objects and advantages sought therefor. It should be understood that many changes, modifications, variations and other uses and applications which do not depart from the spirit and scope of the invention are deemed to be covered by the invention which is limited only by the following claims.

I claim:

1. A separate and removable spark plug shield for use with a spark plug, said shield comprising: an elongated hollow body with a central bore sized to receive the body of a spark plug, said elongated body having an internal shoulder in said central bore facing an end of the elongated body for engagement with the body of a spark plug, said elongated body having means cooperative with and securable to an engine for axially forcing said body of said plug toward said engine and clamping the body of said plug between said shoulder and the engine, and means at the other end of said body for connecting a shielded ignition wire to said body in contact with the plug.

2. A spark plug shield as defined in claim 1, wherein said means cooperative with an engine comprises a thread on said body.

3. A spark plug shield as defined in claim 1, wherein said means cooperative with an engine comprises a thread on said body having wrench surfaces enabling threading of said thread into a threaded bore in said engine.

4. A spark plug shield as defined in claim 1, including an insulating sheath within said body.

5. A spark plug shield as defined in claim 1, including an insulating sheath in said body sealingly engageable with said means for connecting a shielded ignition wire to said body and sealingly engageable with said spark plug.

6. The shield of claim 1 wherein the shield is used with electrode orientable spark plugs.

7. The shield of claim 1 wherein the means cooperative with an engine block comrises at least one clamp.

8. A separate and removable spark plug shield for surrounding a spark plug adapted to have the electrodes thereof fitted in a bore of an engine block, said shield comprising an elongated hollow body with a central opening sized to receive a spark plug, said body having an end fitted into a counterbore in an engine surrounding said bore and having a portion of said end below the surface of the engine block, means for securing said end of said body to said engine block within said counterbore so that substantially the entire portion of said spark plug is enclosed by said shield, shoulder means on said body located in said central opening and in proximity to said end to engage a shoulder portion on a spark plug and clamp same to aid engine block, and means at the other end of said body for operatively connecting an ignition wire to a spark plug.

9. The spark plug shield of claim 8 wherein said shoulder on said body engages the shoulder portion on said spark plug.

10. A spark plug shield as defined in claim 8, including an insulating sheath within said body.

11. The spark plug shield of claim 8 wherein the means for securing said body to said engine block is a threaded securement means on said first-named end.

12. The spark plug shield of claim 11 wherein said body has wrench surfaces thereon to enable threading of said threaded securement means into a threaded portion in said counterbore.

13. A shielded, oriented spark plug assembly comprising an engine part having a spark lug bore, a spark plug having a body disposed in said bore, means for positively orienting said body in said bore, said body having a shoulder facing outwardly of said bore, a separate and removable shield disposed around said spark plug, said shield having a central opening to receive the body of the spark plug and having a shoulder in said opening engaged with the shoulder on said body for axially forcing the body of the spark plug in said bore, and means clamping said shield on said engine part with said shoulders holding said body in said bore.

14. The assembly of claim 13 wherein the means for positively orienting the body is a keyway means.

15. The assembly of claim 13 wherein the means for clamping the shield to the engine part is located within a counterbore surrounding said spark plug bore.

16. A separate and removable plug shield for use with a spark plug having a casing and orientable electrodes for extension through a bore in an engine block and with means for positively orienting said casing in said bore, said shield comprising an elongated hollow body with a central opening sized to receive the casing of a spark plug, said elongated body having an internal shoulder in said central opening facing an end of the elongated body for engagement with the end of said elongated body fitted into a counterbore of said engine surrounding said bore and having a piston below the surface of said engine block, said elongated body having threaded means cooperative with and securable to an engine for axially forcing said casing of said plug toward said engine and clamping the casing of said plug between said shoulder and the engine, and means at the other end of said body for connecting a shielded ignition wire to said body in contact with the plug.

17. A spark plug shield as defined in claim 16, wherein said body has wrench surfaces enabling threading of said threaded means into a threaded bore in said engine.

18. A spark plug shield as defined in claim 16, including an insulating sheath within said body.

* * * * *